US005848791A

United States Patent [19]

Beyer et al.

[11] Patent Number: 5,848,791

[45] Date of Patent: Dec. 15, 1998

[54] MOVING PLATFORM/TARGET SYSTEM

[76] Inventors: Christopher P. Beyer, 1839 Stonypoint Rd., Grand Island, N.Y. 14072; Kevin Niebel, P.O. Box 462, Brocton, N.Y. 14716

[21] Appl. No.: 958,121

[22] Filed: Oct. 27, 1997

[51] Int. Cl.[6] ..... F41J 9/00

[52] U.S. Cl. ..... 273/359

[58] Field of Search ..... 273/359, 366, 273/367, 368, 369, 370

[56] References Cited

U.S. PATENT DOCUMENTS

| | | | |
|---|---|---|---|
| 919,378 | 4/1909 | Pinkston | 273/366 |
| 3,082,002 | 3/1963 | Goldfarb . | |
| 3,128,096 | 4/1964 | Hammond et al. | 273/367 |
| 3,865,373 | 2/1975 | Knight | 273/369 |
| 4,625,973 | 12/1986 | Dallaire | 273/366 |
| 5,255,629 | 10/1993 | Paterson | 273/366 X |
| 5,568,927 | 10/1996 | Badorrek | 273/366 |

*Primary Examiner*—William H. Grieb
*Attorney, Agent, or Firm*—Michael I. Kroll

[57] ABSTRACT

A moving platform/target system (10) for traveling along a predetermined path. The moving platform/target system (10) includes a track (14) defining a predetermined path and a platform (12) engaging the track (14) for movement along the track (14). The platform (12) includes a housing from which wheels (22) extends from opposite sides thereof and facing parallel to the track (14). A guiding device (26, 28) extends from the housing and engages the track (14), retaining the platform (12) in alignment with the track (14). A power circuit (62, 64, 66, 68, 70) is positioned within the housing and is connected to turn the wheels (22) and impart motion to the platform (12). A sensor (32) senses a position of the platform (12) and pauses the forward motion upon sensing a predetermined position along the track (14). The sensor (32) constantly transmits a position signal which is reflected back towards the sensor (32) upon passing of reflectors (16) positioned along the length of the track (14) wherein movement of the platform (12) is ceased for a predetermined time period upon receipt of a reflected signal. The motion of the platform (12) may also be ceased in the same manner using a second sensor (84) and additional reflectors. Furthermore, the pause time of the platform (12) is adjustable as its speed. Control of the platform's movement may be remotely through a transmitter device (126) and the platform (12) may also house a second motor (122) for moving the platform (12) in a forward, reverse, left and right direction.

19 Claims, 11 Drawing Sheets

MOVING PLATFORM/TARGET SYSTEM

BACKGROUND OF THE INVENTION

1. Field of the Invention

The instant invention relates generally to moving target systems and, more specifically, to a target system movable along a track.

2. Description of the Prior Art

Numerous moving target systems for use in target shooting are provided in the prior art. For example, U.S. Pat. Nos. 3,082,002; 3,128,096; 3,865,373; 4,625,973; 5,255,629 and 5,568,927 are all illustrative of such prior art. While these units may be suitable for the particular purpose to which they address, they would not be as suitable for the purposes of the present invention as heretofore described.

U.S. Pat. No. 3,082,002

Inventor: A. E. Goldfarb

Issued: Feb. 2, 1959

This invention relates to a traveling or moving target having means for controlling the movement of the target when the target is hit. The invention is primarily adapted in a toy target for use with any toy weapons which discharge a missile or pellet adaptable to strike the target member and actuate it.

U.S. Pat. No. 3,128,096

Inventor: Clinton G. Hammond et al.

Issued: Apr. 7, 1964

This invention relates to a moving target system providing improved means for target practice and training of marksmen. The system simulates conditions which are likely to prevail when engaged in actual firing conditions for both hunting and fishing.

U.S. Pat. No. 3,865,373

Inventor: Lindsay Charles Knight

Issued: Feb. 11, 1975

There is disclosed a target range and mechanisms for use on those target ranges. The mechanisms comprise a trolley for use in shooting ranges wherein the trolley is constructed and arranged to be movable backwards and forwards along a track and including a target moving mechanism adapted, in use, to carry a target and to move the target from an operative shooting position to an inoperative shooting position and wherein the target moving mechanism is adapted to move the target such that in use, the width of the trolley and target across the direction of intended movement of the trolley when the target is in the inoperative shooting position is not substantially greater than the width of the trolley and target across the direction of intended movement of the trolley when the target is in the operative shooting position.

Preferably the trolley has a target moving mechanism such that in use, the plane of the target extends parallel with the direction of intended movement of the trolley in both the operative and inoperative shooting positions.

Preferably the trolley also has a target moving mechanism which is such as, in use, to move the target from the operative to inoperative shooting positions with the plane of the target swinging in a generally vertical plane extending in the direction of intended movement of the trolley.

Alternatively the trolley has a target moving mechanism which is such that in use, the plane of the target extends transverse to the direction of intended movement of the trolley in both the operative and inoperative shooting positions.

The range has a trolley and a track along which the trolley is to move, said track along which the trolley is to move, said track being of a width only sufficiently wide to allow the trolley to pass and being of a depth which when the trolley is in the track the top of the trolley will be below the depth of the track the path further being such that, in use, the trolley and target, when in the inoperative position, are out of sight of a shooter at a firing position and wherein the path over substantially its whole extent is also out of sight of the shooter at the firing position.

U.S. Pat. No. 4,625,973

Inventor: Jean-Guy Dallaire

Issued: Dec. 2, 1986

A mobile target system with a driverless, self-propelled tractor vehicle on relatively low profile and a low profile, wide track trailer with a long drawbar articulately connected to the tractor. Projectile targets are carried by the trailer. The control for the tractor controls the vehicle to drive along a selected path. This may include a ground wire that the tractor follows and a radio control unit for initiating an excursion of the target along the path. The separation of the tractor and the target stability functions allows the use of a relatively small, easily steered tractor vehicle, while the target carrying trailer may be a relatively easily steered single axle target from the tractor provides some modest protection for the tractor.

U.S. Pat. No. 5,255,629

Inventor: Jerry Paterson

Issued: Oct. 26, 1993

Apparatus for the training of cutting horses includes a calf replica mounted to a track for traversing movements along the track. Motive apparatus for causing the calf replica to traverse along the track is reversible in two opposite directions. Program apparatus causes the motive apparatus to execute a programmed series of movements of the calf replica.

U.S. Pat. No. 5,568,927

Inventor: Hal C. Badorrek

Issued: Oct. 29, 1996

A three-dimensional moving target system comprising a track assembly and a three-dimensional target. A structure is for supporting the target in an upright position from the track assembly. A facility is for propelling the supporting structure with the target along the track assembly. An archer can practice at shooting an arrow from a bow at the target traveling along the track assembly.

BRIEF SUMMARY OF THE INVENTION

The present invention is concerned with moving platform/target systems and, more specifically, to a target or platform system able to move in a controlled manner about a defined path.

A primary object of the present invention is to provide moving platform/target system able to traverse a predefined path.

A further object of the present invention is to provide a moving platform/target system able to pause at predetermined positions about the path.

Another object of the present invention is to provide a moving platform/target system having a variable speed control for controlling the speed of the platform/target around the path.

A still further object of the present invention is to provide a moving platform/target system wherein the pause time of the platform/target is adjustable.

Another object of the present invention is to provide a moving platform/target system able to stop forward motion at any point along the path.

A further object of the present invention is to provide a moving platform/target system able to be remotely controlled by an operator.

An even further object of the present invention is to provide moving platform/target system able to travel in reverse around the path when using a remote control transmitter.

A moving platform/target system for traveling along a predetermined path is disclosed by the present invention. The moving platform/target system includes a track defining a predetermined path and a platform slideably engaging the track for movement along the track. The platform includes a housing from which a wheel extends from opposite sides thereof and facing parallel to the track. A guiding device extends from the housing and engages the track, retaining the platform aligned with the track. A power circuit is positioned within the housing and is connected to turn the wheels and impart motion to the platform. A sensor senses a position of the platform and pauses the forward motion of the platform upon sensing a predetermined position along the track. The sensor constantly transmits a position signal which is reflected back towards the sensor upon passing of reflectors positioned along the length of the track wherein movement of the platform is ceased for a predetermined time period upon receipt of a reflected signal. The motion of the platform may also be ceased in the same manner using a second sensor and an additional reflector. Furthermore, the pause time of the platform is adjustable as is the speed of the platform. Control of the movement of the platform may be performed remotely through a transmitter device and the platform may also house a second motor whereby each motor controls one wheel providing for movement of the platform in the left and right directions.

The foregoing and other objects, advantages and characterizing features will become apparent from the following description of certain illustrative embodiments of the invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
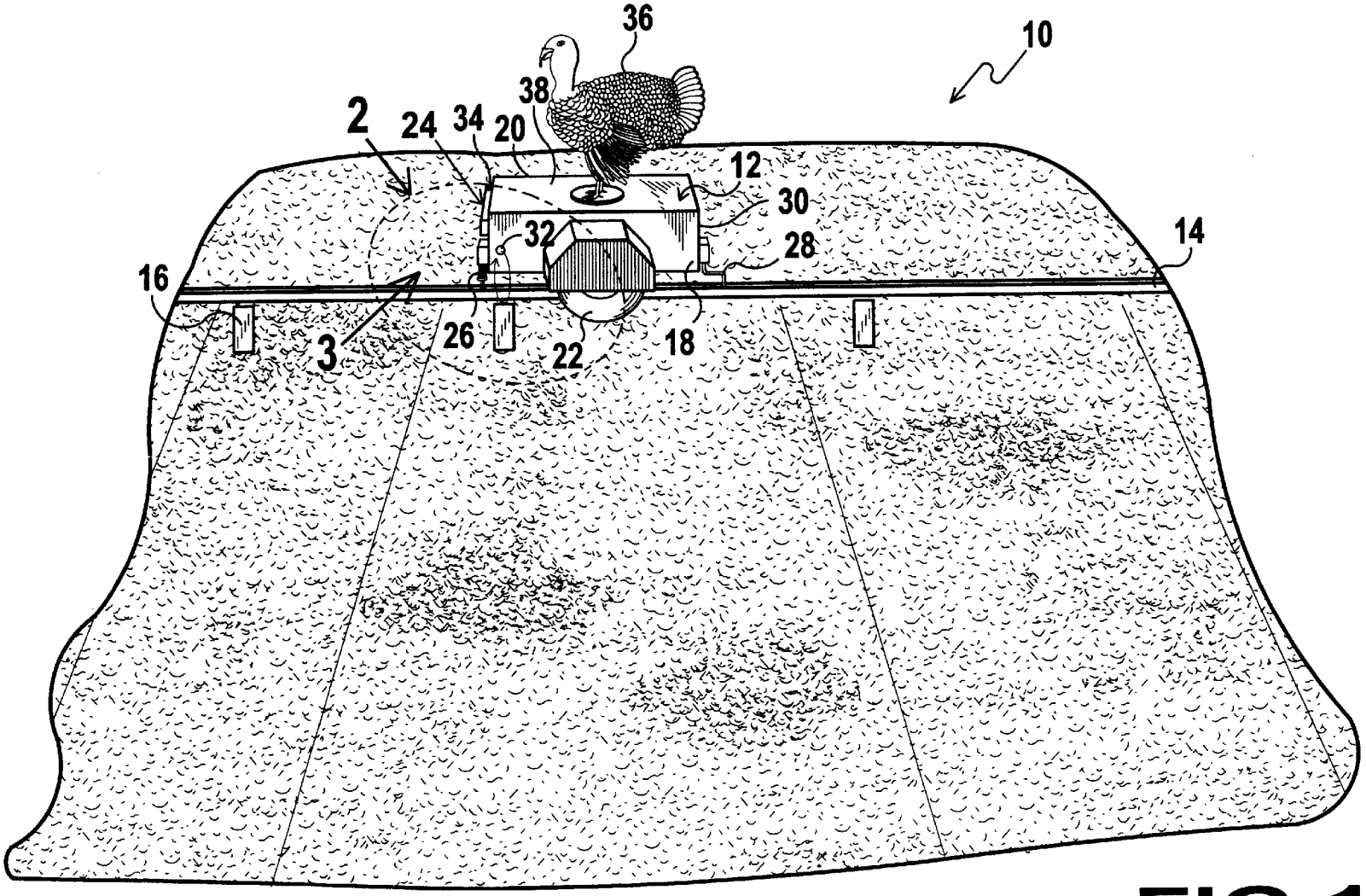
FIG. 1 is a perspective view of a first embodiment of the moving platform/target system of the present invention.

Turning now descriptively to the drawings, in which similar reference characters denote similar elements throughout the several views, the Figures illustrate the moving platform warning system of the present invention. With regard to the reference numerals used, the following numbering is used throughout the various drawing figures.

10 mobile platform/target system of the present invention
12 platform
14 track
16 plurality of pause reflectors
18 first elongated side of platform
20 second elongated side of platform
22 wheel
24 front side of platform
26 first guide assembly
28 second guide assembly
30 back side of platform
32 pause sensor
34 control panel
36 target
38 top side of platform
40 first side wall of track
42 second side wall of track
44 first protruding wall of track
46 second protruding wall of track
48 recess
50 roller
52 spring

54 first stop block
56 second stop block
58 control cover
60 hinge
62 motor
64 first gear
66 second gear
68 axle
70 chain
72 bearing
74 base of platform
76 electrical charging input
78 emergency stop button
80 ignition switch (on-off-reset)
82 speed control
84 stop sensor
86 logic circuit
88 driver circuit
90 pause relay/timer
92 stop relay/timer
94 power source
96 switch
100 guide wire
102 first support swivel wheel
104 second support swivel wheel
106 first extension
108 second extension
110 spring loaded hinges
112 first swivel caster
114 second swivel caster
116 caster bolts
120 first power circuit
122 second power circuit
124 antenna/receiver
126 transmitter
128 first wire sensor
130 second wire sensor
132 signal transmitter/voltage source
134 on/off/remote switch

DETAILED DESCRIPTION OF THE PREFERRED EMBODIMENT

Referring now to FIGS. 1–6 and 11, a preferred embodiment of the mobile platform/target system of the present invention is illustrated.

Specifically, FIG. 1 shows a preferred embodiment of the mobile platform/target system indicated generally by the numeral 10. The system 10 includes a moving platform 12 and a path or track 14 along which the platform 12 moves. Positioned on a first side of and along the length of the track 14 are a plurality of pause reflectors 16. Positioned at either end of the track on a side opposite the plurality of pause reflectors 16 is a single stop reflector (not shown).

The moving platform 12 is preferably in the form of a rectangular box, although any shape which is able to perform the necessary functions and house the necessary components as will be described hereinafter may be used. Positioned on each elongated side 18, 20 of the platform 12 and in parallel alignment with the track 14 are wheels 22. Connected to the front face 24 of the platform 12 and extending downward to engage the track 14 is a first guide assembly 26. A second guide assembly 28 extends from a back side 30 of the platform 12 also engaging the track 14. On the first elongated side 18 of the platform 12 and facing perpendicular thereto is a pause sensor 32 for sensing the presence of each of the plurality of pause reflectors 16 as the platform 12 travels along the track 14. The pause sensor 32 pauses the movement of the platform 12 upon sensing the passing of one of the plurality of pause reflectors 16. The pause period may be varied and is normally in the range of 0–60 seconds. On the front face 24 of the platform 12 is a control panel 34 which will be discussed in more detail hereinafter with specific reference to FIGS. 3–6. When the system 10 is used for target practice or in a shooting tournament, a target 36 may be secured to a top side 38 of the platform 12.

Figure 2:
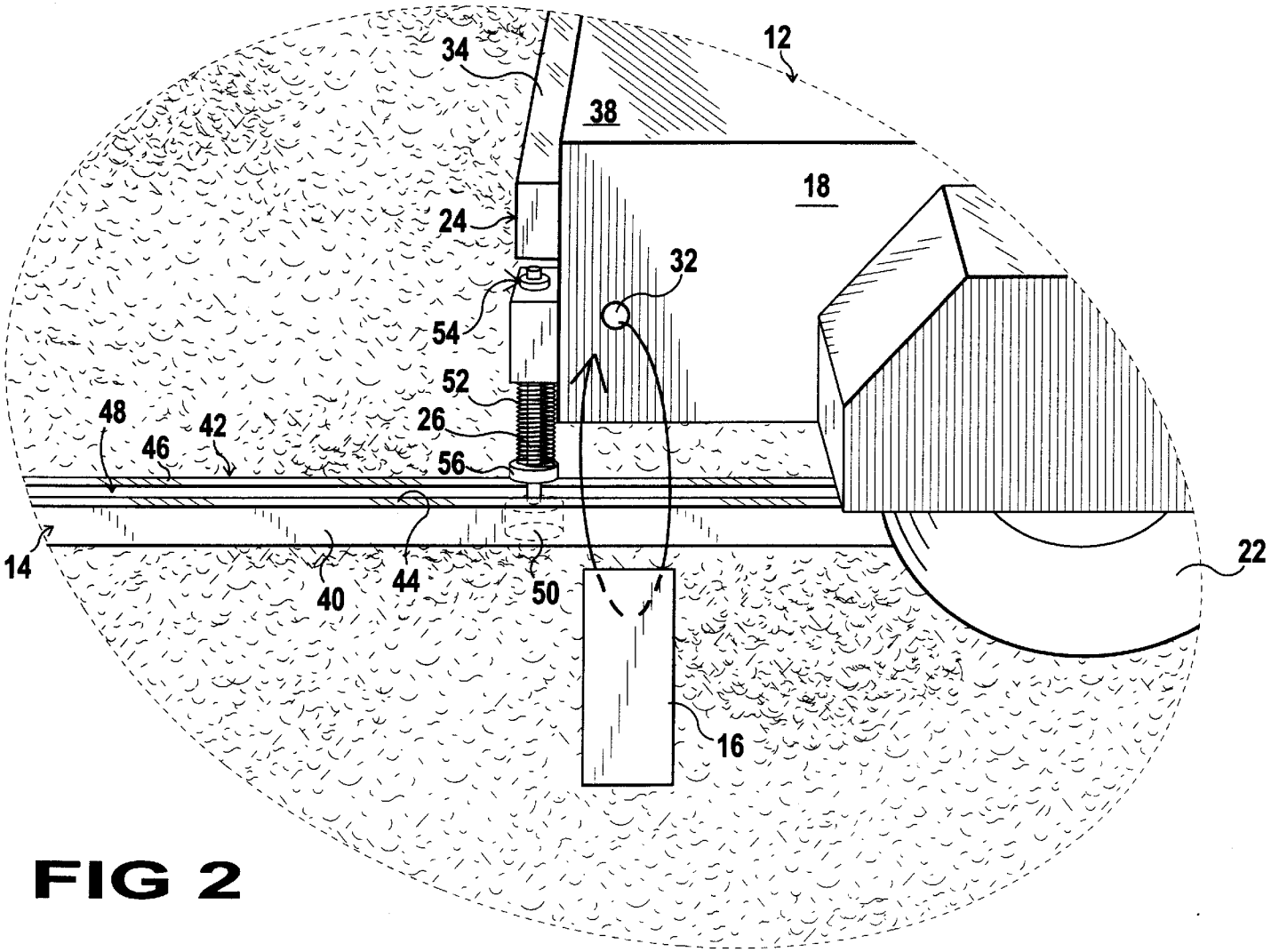
FIG. 2 is a perspective view of the sensor unit of the moving platform/target system of the present invention taken within the circle labeled 2 in FIG. 1.

FIG. 2 shows the pause sensor 32 and first guide assembly 26 in more detail. The pause sensor 32 constantly transmits a signal as the platform 12 travels along the track 14. When the platform 12 approaches one of the plurality of pause reflectors 16, the transmitted signal is reflected back to the pause sensor 32. Upon receipt of the reflected signal, the pause sensor 32 acts to temporarily halt movement of the platform 12 for the predetermined and adjustable preset pause time.

The track 14 is defined by first and second parallel opposing side walls 40, 42. Each side wall 40, 42 includes a protruding wall 44, 46, respectively, extending perpendicularly thereto from a side opposite the ground and towards the opposing side wall 42, 40. A recess 48 defined by the opposing side walls 40, 42 and protruding walls 44, 46 is thus formed. The first guide assembly 26 extends into the recess 48 and includes a roller 50 retained within the recess 48 by the protruding walls 44, 46. The first guide assembly 26 also includes a spring 52 positioned between first and second stop blocks 54, 56. The first guide assembly 26 is slideably connected to the first stop block 54 whereby the combination of the first guide assembly 26, the spring 52 and the first and second stop blocks 54 and 56 act as a shock absorber to hold the platform 12 steady when traveling over bumps around the path defined by the track 14.

Figure 3:
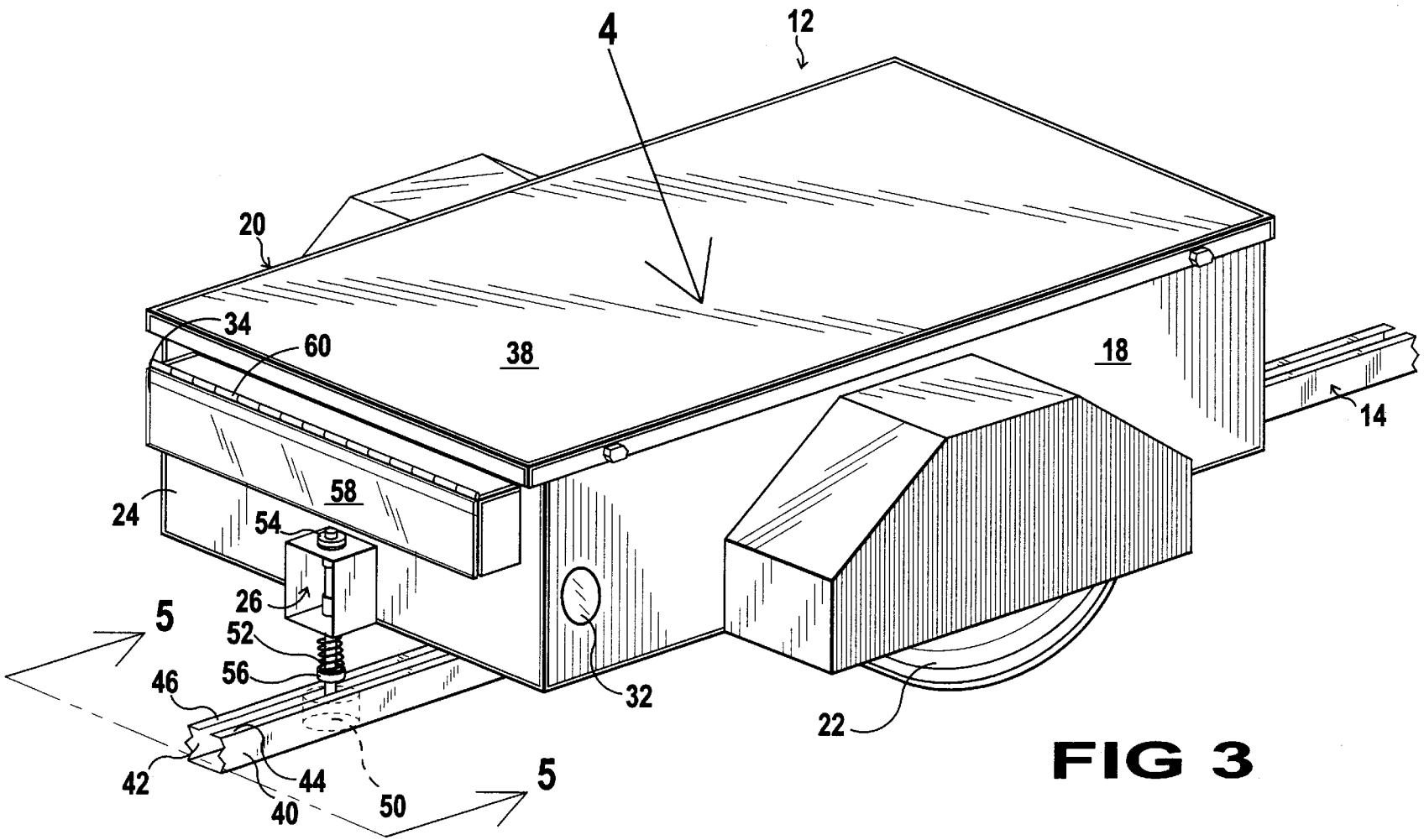
FIG. 3 is a perspective view of the platform of the moving platform/target system of the present invention.

FIG. 3 illustrates the platform 12 in more detail. The control panel 34 can more clearly be seen as having a cover 58 pivotally attached to the panel 34 by a hinge 60. Thus, the control panel 34 may be protected from external influences and exposed only with the intent to effect a change in the present control values.

Figure 4:
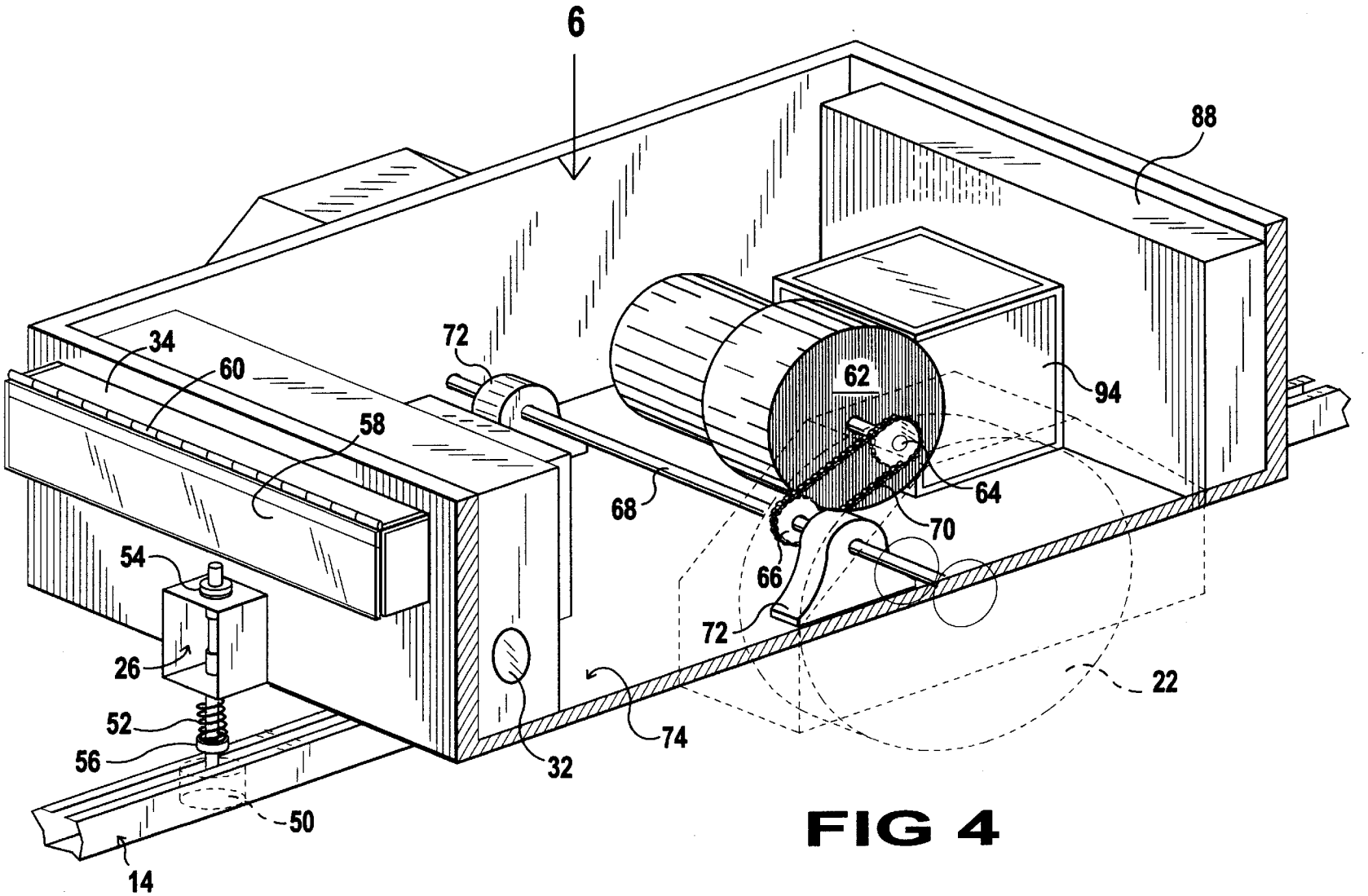
FIG. 4 is a cross-sectional view of the platform of FIG. 3 illustrating the components therein of the moving platform/target system of the present invention.

The powering device for rotating the wheels 22 and thus placing the platform 12 in motion along the track 14 is shown in FIG. 4. The powering device consists of a power source 94 connected to supply power to a motor 62. When activated the motor 62 acts to turn a first gear 64. The first gear 64 is connected to a second gear 66 via a chain 70. The second gear 66 is rotatable about an axle 68 extending between and connected to the wheels 22. The axle 68 is rotatably held in a stationary position by a bearing 72 connected to a base 74 of the platform 12. Each gear 64, 66 is configured with teeth to engage the chain 70. Thus, when the motor 62 causes the first gear 64 to turn, the chain 70 engaged by the teeth of the first gear 64 acts to turn the second gear 66 which in turn turns the axle 68 and the wheels 22 connected thereto. The activation of the motor 62 to turn the gears 64, 66, the axle 68 and the wheels 22 thus causes the platform 12 to travel along the track 14 and around the path.

While a preferred structure for imparting motion to the platform 12 is shown and described herein, those of ordinary skill in the art who have read this description will appreciate that there are numerous other structures for the device and, therefore, as used herein the phrase "powering means for turning the wheels and imparting motion to the platform" should be construed as including all such structures as long as they achieve the desired result of turning the wheels and imparting motion to the platform, and therefore, that all such alternative mechanisms are to be considered as equivalent to the one described herein.

Figure 5:
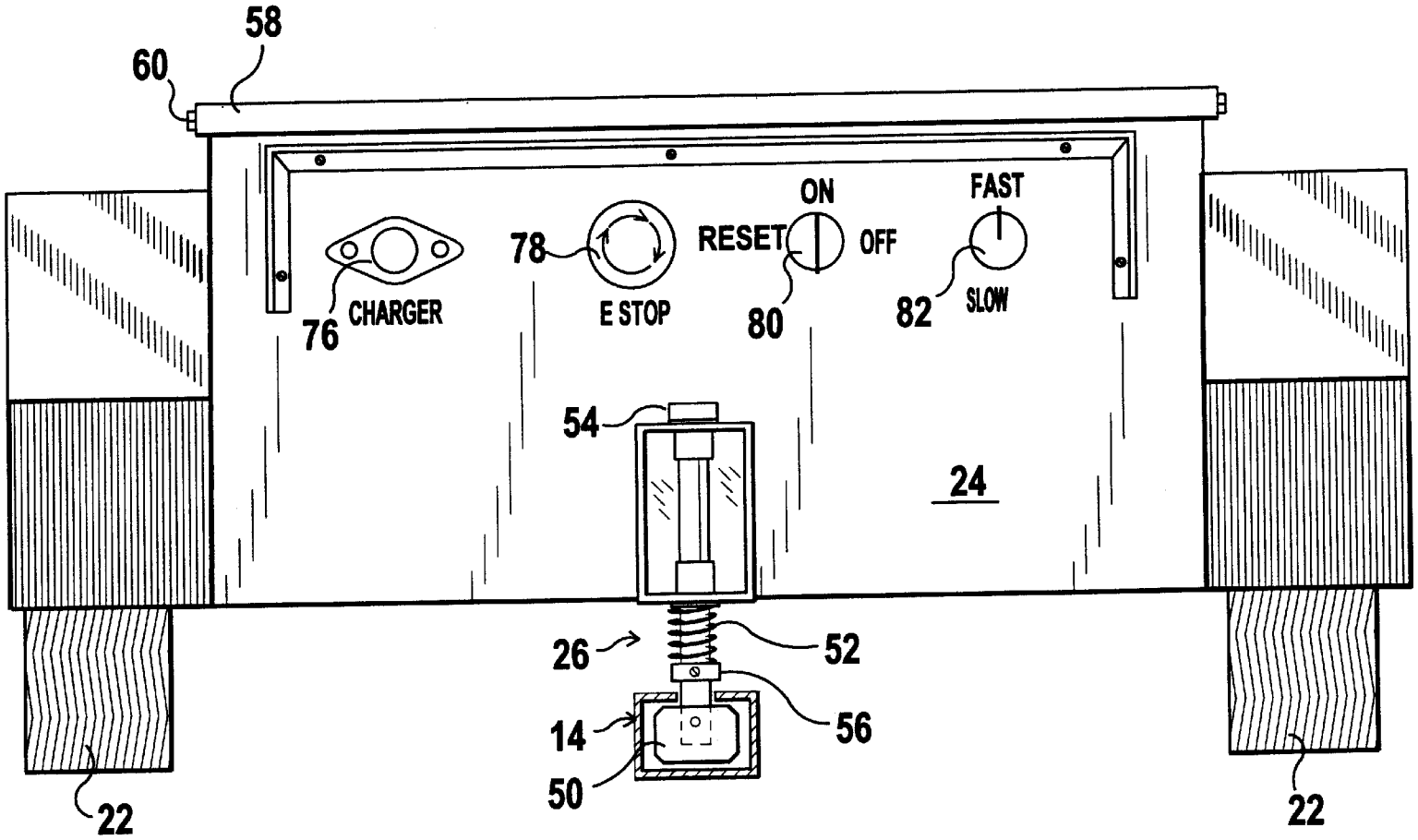
FIG. 5 is a front view of the platform as shown in FIG. 3 of the moving platform/target system of the present invention.
Figure 6:
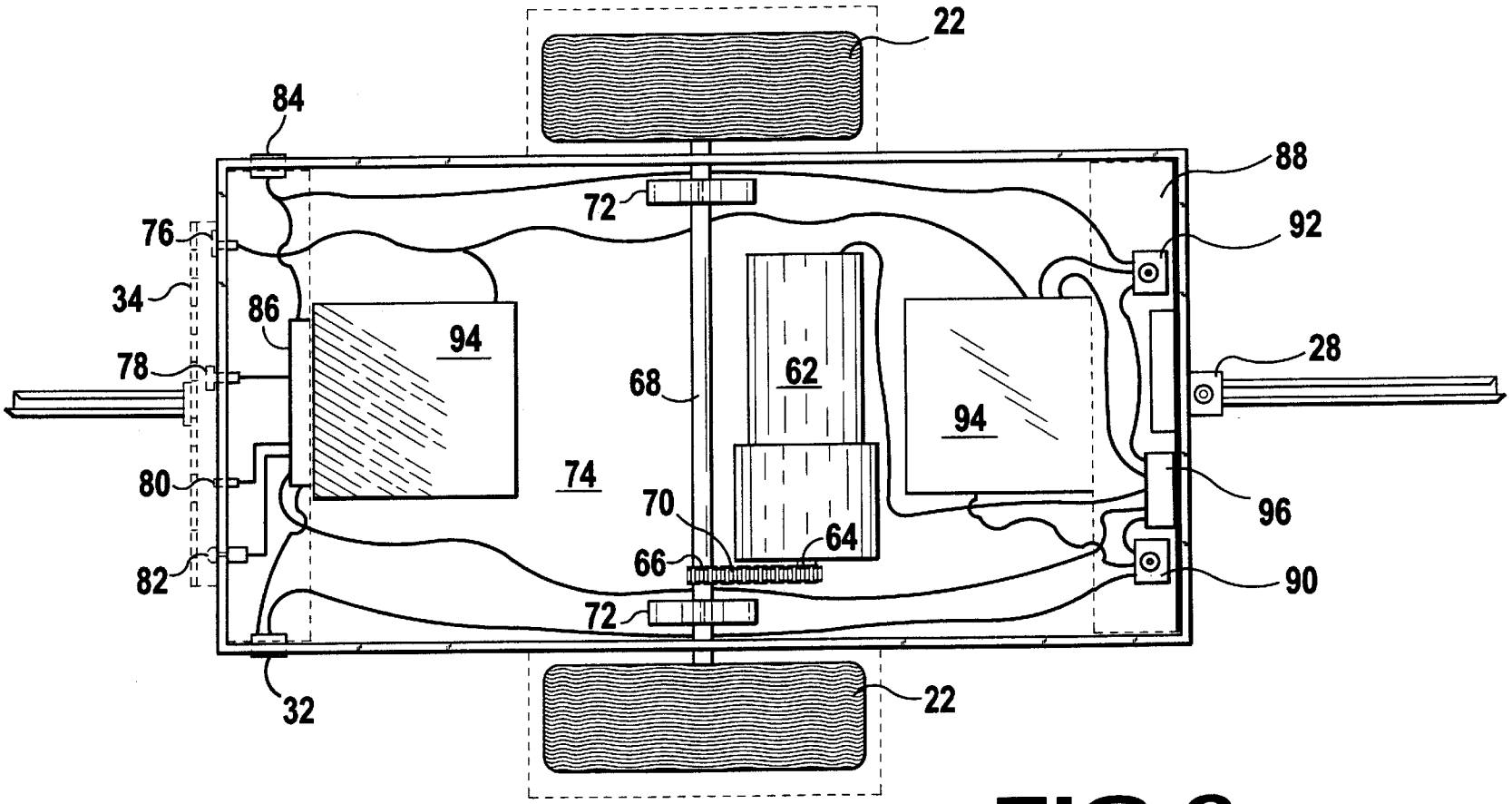
FIG. 6 is a top cross-sectional view of the platform shown in FIG. 3 of the moving platform/target system of the present invention.
Figure 7:
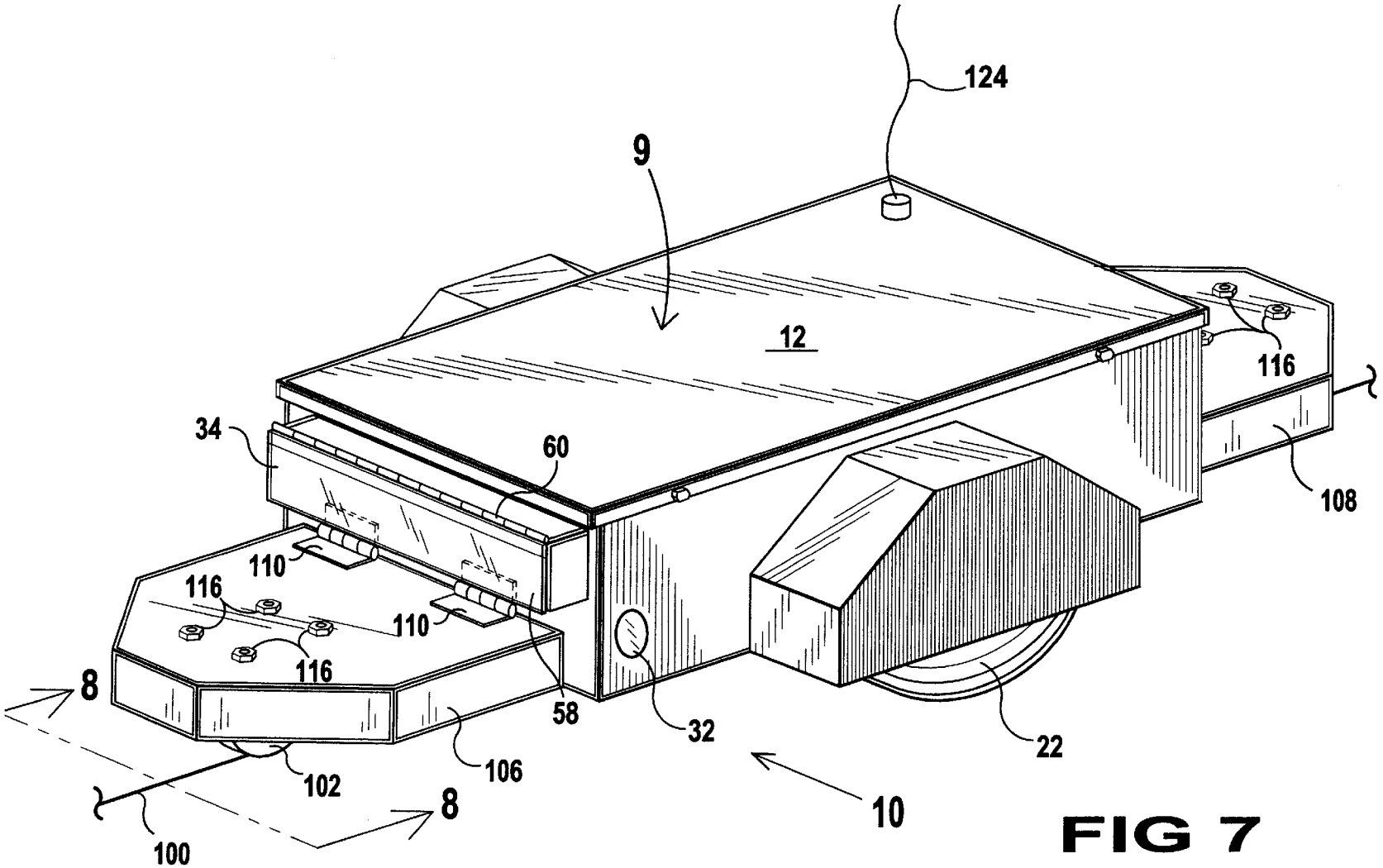
FIG. 7 is a perspective view of a second embodiment of the moving platform/target system of the present invention.
Figure 8:
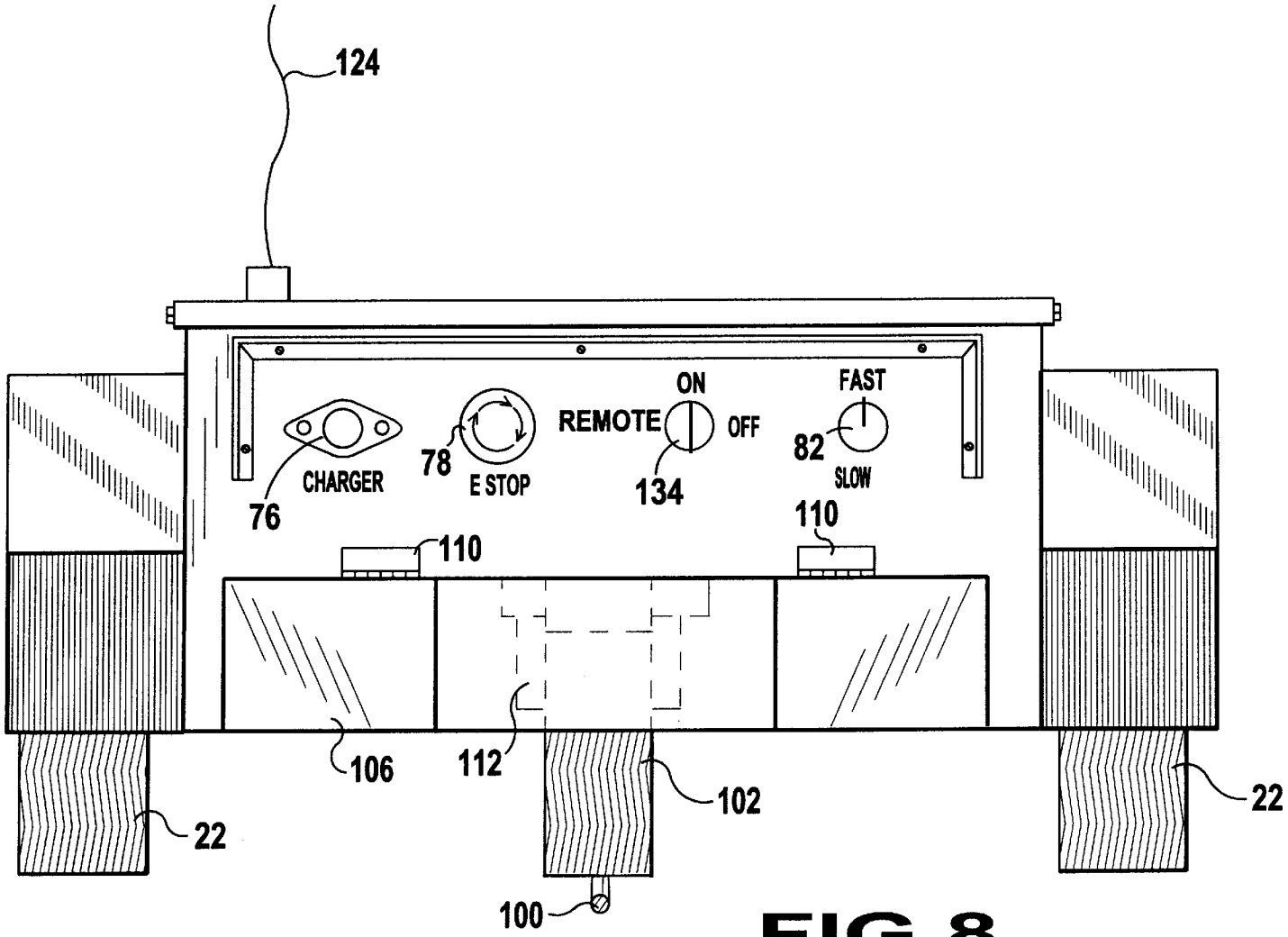
FIG. 8 is a front view of the platform of the moving platform/target system of the present invention as shown in FIG. 7.
Figure 11:
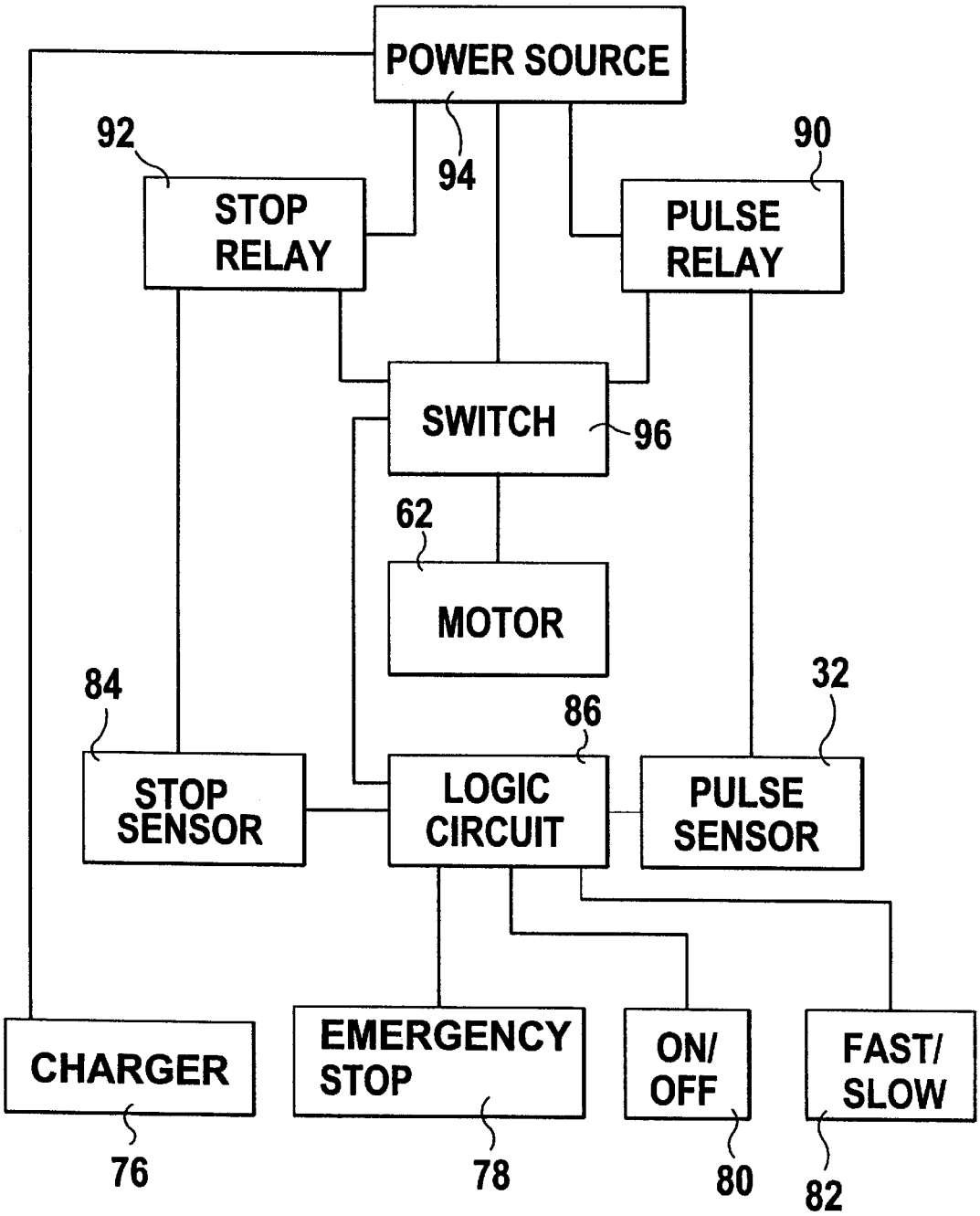
FIG. 11 is a schematic drawing of the internal components of the platform of the moving platform/target system of the first embodiment of the present invention.

FIGS. 5, 6 and 11 illustrate the control panel 34 and the circuitry used to control the operation and motion of the platform 12. The external controls on the control panel 34 are shown in FIG. 5. These controls include an electrical input or charger 76 for charging an internal power source 94, an emergency stop button 78, an on/off/reset switch 80 and a speed control 82. The internal power source 94 may be either a single or two rechargeable batteries or the like as long as it is able to power the wheels to impart motion to the platform 12.

FIG. 6 illustrates the powering and sensing components of the platform 12 in more detail while FIG. 11 illustrates these components schematically. In addition to the control panel 34 and pause sensor 32, a stop sensor 84 is positioned on the second elongated side 20 of the platform, opposite the pause sensor 32. As mentioned above, the stop sensor 84 senses the passing of a stop reflector by the platform 12 and, in response thereto, ceases forward motion of the platform 12. The forward motion of the platform 12 is ceased until reset by switch, then the delay occurs after reset. The charger input 76 is preferably in the form of a three pronged input for connection of an electrical adapter. However, the charging input 76 may take any known and useful form as long as an adapter may connect the charging source to charge the internal power source 94 located within the platform 12. The remaining controls on the control panel 34, i.e. emergency stop 78, ignition switch 80 and speed control 82; the pause sensor 32; and the stop sensor 84 are connected to a logic circuit 86. The pause sensor 32 is also connected to a pause relay 90. The stop sensor 84 is also connected to a stop relay 92. The power source 94 is connected directly to a switch 96. The pause relay 90 and stop relay 92 are each connected between both the power source 94 and switch 96 and are used to adjust the pause and stop periods, respectively. The logic circuit 86 is coupled to transmit a signal for controlling the switch 96. Based on the control signal received from the logic circuit 86, the switch provides power to the motor 62.

A second embodiment of the present invention will now be described with reference to FIGS. 7–10. Identical numerals indicate like elements in both the first and second embodiments. In the second embodiment the track is replaced by a guide wire 100 defining the path to be traversed by the platform 12. The platform 12 includes first and second swivel caster wheels 102, 104 for supporting the platform 12 and absorbing shock while traveling along the wire guide 100. The guide wheels 102, 104 replace the first and second guide assemblies 26, 28, respectively, of the first embodiment and are each connected to an extension 106, 108 protruding from a respective side of the platform 12. The extensions 106, 108 are connected to the platform 12 by spring loaded hinges 110 and the first and second swivel caster wheels 102, 104 are rotatably connected to their respective extensions 106, 108 by a swivel caster bracket 112, 114. Each swivel caster bracket 112, 114 is connected to its respective extension by bolts 116. The spring loaded hinges 110 are adjustable, forcing their respective extensions 106 and 108 downward towards the ground to help absorb shock as well as insure the drive wheels maintain constant contact with the ground.

Figure 9:
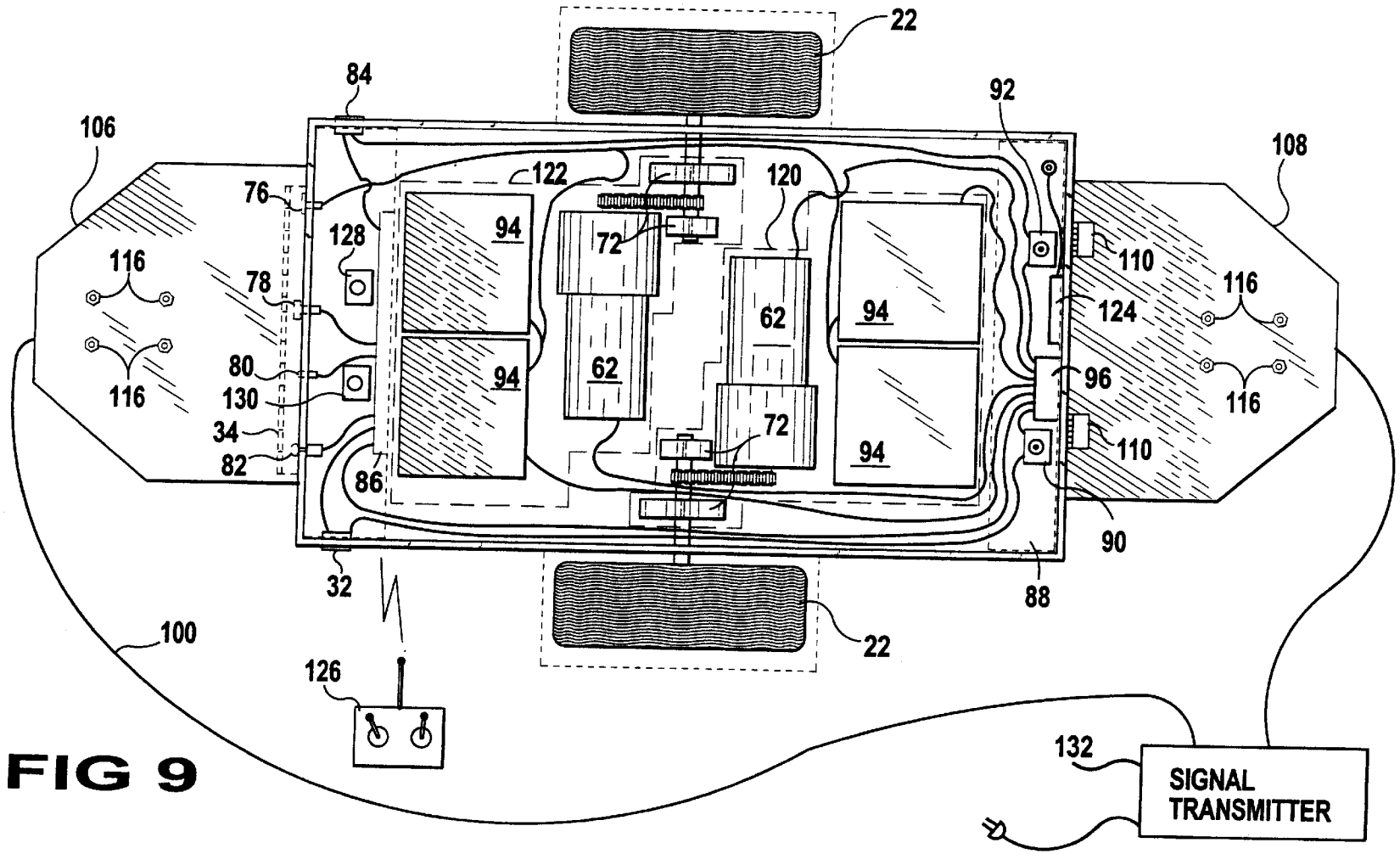
FIG. 9 is a top cross-sectional view of the platform of FIG. 7 illustrating the components therein of the moving platform/target system of the present invention.
Figure 10:
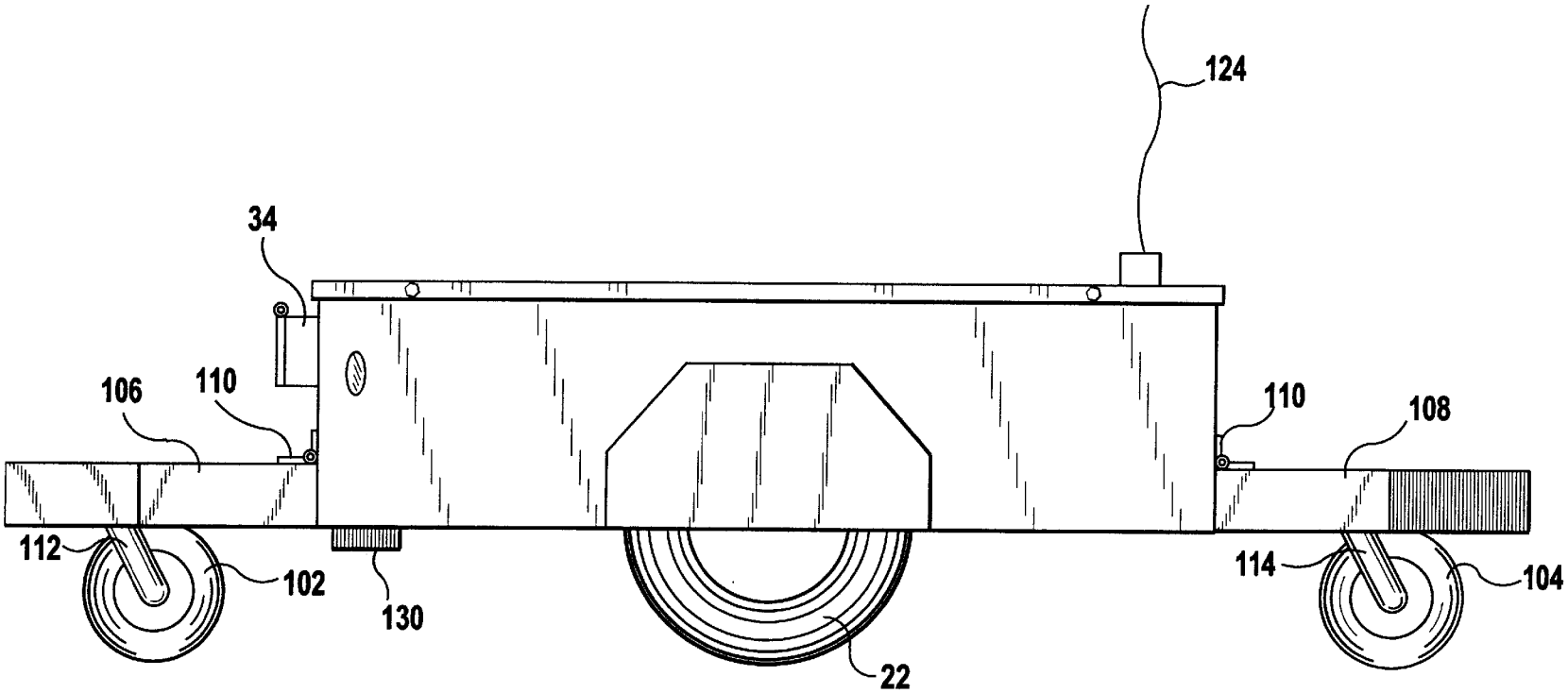
FIG. 10 is a side view of the platform as shown in FIG. 7 of the moving platform/target system of the present invention.

Furthermore, this embodiment includes first and second power circuits 120, 122 as illustrated in FIG. 9. The power circuits 120, 122 are identical to the powering device used for imparting motion to the wheels described with reference to the first embodiment. The addition of the second power circuit 122 allows the platform 12 to steer in the left and right directions. Each power circuit 120 and 122 is connected to drive a respective wheel 22 whereby altering the speed at which either wheel turns with respect to the other will cause the platform to turn to either the left or right.

When traveling in either the forward or reverse directions, both the first and second power circuits 120, 122 will be operational and act to rotate the wheels in unison in the desired direction. If the platform is needed to turn in the left or right direction, a respective one of the power circuits will electronically "brake" causing the platform to turn in the desired left or right direction. This powering system is known in the art and is similar to the steering control of a tank or bulldozer.

The guide wire 100 is connected to a signal transmitter 132 which applies a low frequency/low voltage signal to the wire causing an electrical current to flow through the guide wire 100. First and second sensors 128 and 130 are positioned on a bottom side of the platform 12, each being connected to a respective power circuit 120, 122. The platform 12 is positioned such that the guide wire 100 passes between the first and second sensors 128 and 130. As the platform 12 travels along the guide wire 100, the sensors 128 and 130 sense the current passing through the guide wire 100 to thereby determine the position of the platform 12 with respect to the guide wire 100. If the sensed position of the platform 12 deviates from the desired position with respect to the guide wire 100, the sensors 128 and 130 signal the appropriate power circuit 120 or 122 to vary the speed of its associated wheel causing the platform 12 to turn to either the left or right and correct its position along the guide wire 100. If the current is no longer sensed by the first and second sensors 128, 130 power to the first and second power circuits 120, 122 will be cut off and movement of the platform will cease.

Connected to both the first and second power circuits 120, 122 is a receiver device 124 including an antenna. The receiver device 124 receives remote signals at its antenna from a transmitter 126 operated by a user for activating the first and second power circuits 120 and 122. This allows for remote control of the platform 12 when the on/off/remote switch 134 is in the remote position. The on/off/remote switch 134 operates identically to the on/off/reset switch 80 of the first embodiment except it allows for remote operation. The receiver 124 is connected to the logic circuit 86. The logic circuit 86 will relay the received signal to the switch 96 for activating the power circuits 120 and 122 to move the platform 12 in the desired direction, i.e. left, right, forward or reverse.

In operation, the platform 12 is positioned either on the track 14 with the roller 50 contained within the recess 48 or with the guide wheels 102, 104 positioned over the guide wire 100. Prior to use the power source 94 may be charged by connecting the platform 12 to an electrical outlet at the electrical input or charger connection 76. Once the power source 94 is charged, the pause time and stop time are set by turning the respective adjustment knobs on the pause and stop relays 90, 92, respectively, and the speed of the platform 12 is set by adjusting the speed indicator on the control panel 34. Adjustment of the speed indicator 82 will regulate the amount of power supplied by the power source 94 through the switch 96 and to the motor 62. Thus, the speed at which the motor 62 causes the first and second gears 64, 66 and the wheels 22 to turn is controlled. This is performed using a potentiometer to apply an adjustable resistance and regulate the amount of power delivered to the motor 62. The motor 62 is turned on by turning the ignition switch 80 and thus supplying power thereto and the cover 58 of the control panel 34 is then closed. The platform 12 may now travel along the predefined path. In the wire guided system, the signal transmitter 132 is turned on causing a current to flow through the guide wire 100, the sensors 128 and 130 being positioned on either side of the guide wire 100 for sensing the position of the platform 12 with respect to the wire 100.

If a remote control transmitter 126 is used movement and direction of the platform 12 is controlled by a user from a remote location. In this instance, the on/off/remote switch 134 must be placed in the remote mode. Using the transmitter 126, the platform 12 may be activated and controlled to move in either a forward, reverse, left or right direction. The direction signal transmitted to the receiver 124 by the transmitter 126 is delivered to the logic switch 86 which sends a control signal to the switch 96 causing power to be supplied to the two power circuits 120, 122 for moving the platform 12 in the forward or reverse direction.

Upon activation of the drive motor 62 the wheels 22 are caused to rotate and propel the platform 12 in the desired direction. The pause and stop sensors 32, 84 also begin to transmit a signal. As the platform 12 travels around the track 14 or guide wire 100 a shooter or archer fires at the target 36 atop the platform 12 as it passes through a predefined target lane. Within each target lane are a plurality of pause reflectors 16, the number and spacing of the pause reflectors 16 is predetermined and may be adjusted based upon a users preferences. As the platform 12 travels around the path the signal transmitted by the pause sensor 32 is reflected back to the pause sensor 32 upon passing each of the plurality of pause reflectors 16. Upon receipt of the reflected signal, the pause sensor 32 is activated. The pause sensor 32 sends a signal to the logic circuit 86 and to the pause relay 90 activating the pause relay 90. Upon receipt of this signal, the logic circuit 86 controls the switch 96 to connect the power source 94 to the motor through the connection with the pause relay 90. As the pause relay 90 has been activated by the pause sensor 32, the power supplied to the motor 62 by the power source 94 will be cut off for a period equal to the preset pause period. This pause period allows an archer or shooter to reload the weapon. Upon expiration of the pause period, the power supply 94 will be reconnected to the motor 62 thereby supplying power to the motor 62 and allowing the platform 12 to continue its motion along the path. As the platform 12 passes another pause reflector 16 the motion of the platform 12 is once again ceased for the predetermined period as this process repeats. This process continues until the platform 12 travels through the entire course and the stop sensor 84 receives a reflected signal from the stop reflector at the end of the target course.

In the wire guided system, the sensors 128 and 130 continually sense the position of the platform 12 with respect to the guide wire 100 passing therebetween. If the position of the platform 12 varies such that the position of the guide wire 100 with respect to the sensors 128 and 130 changes, the sensors 128, 130 control the speed of the motors 120 and 122 to vary and turn the platform in either the left or right direction and thereby correct the position of the platform 12. Reducing the speed of one wheel with respect to the other wheel acts to turn the platform in one direction or the other based upon which wheel's rotation is slowed.

The sensing of a stop reflector by the stop sensor 84 occurs in the same manner as sensing of the pause reflectors 16 by the pause sensor 32. Upon sensing the passing of a stop reflector by the stop sensor 84, the stop sensor 84 sends a signal to both the logic circuit 86 and the stop relay 92. Upon receipt of this signal, the logic circuit 86 controls the switch 96 to disconnect the power source 94 to the motor through the connection with the stop relay 92. As the stop relay 92 has been activated by the stop sensor 84, the power supplied to the motor 62 by the power source 94 will be cut off.

The platform 12 may also be caused to stop by pressing the emergency stop button 78 or turning the ignition switch 80 to the off position. If the emergency stop button 78 is pressed a signal will be sent to the logic circuit 86 which controls the switch 96 to disconnect the power supply 94 from the motor 62. When the ignition switch 80 is engaged, a signal is transmitted to the logic circuit 86 which controls the switch 96 to connect the power supply 94 directly to the stop relay/timer 92 where the unit will delay starting for a predetermined amount of time before connecting power to the motor 62 causing the motor 62 to operate and turn the wheels 22 as previously described.

The speed of the platform 12 may be controlled by turning the speed control knob 82 on the control panel 34. The turning of the speed control knob 82 sends a signal to the logic circuit 86 which controls a variable resistance between the switch 96 and the motor 62 or power circuits 120, 122 to regulate the amount of power supplied to the motor and thus, control the speed at which the wheels 22 are turned and the platform 12 moves.

It is thus evident that the moving platform/target system of the present invention is able to traverse a predefined path while pausing the platform at predetermined positions about the path, the pause time being adjustable. The platform is also able to move about the path at a variable speed or even to stop forward motion at any point along the path under the control of an operator by adjusting controls located on the platform.

It will be understood that each of the elements described above, or two or more together, may also find a useful application in other types of applications differing from the type described above.

While the invention has been illustrated and described as shown in the drawings, it is not intended to be limited to the details shown, since it will be understood that various omissions, modifications, substitutions and changes in the forms and details of the formulation illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of this invention.

What is claimed as new and desired to be protected by Letters Patent is set forth in the appended claims:

1. A moving platform/target system for traveling along a predetermined path, said moving platform/target system comprising:

a) track means defining a predetermined path;

b) platform means slideably engaging said track means for movement along said track means, said platform means including:

a housing;

at least one wheel extending parallel to said track;

guiding means extending from said housing for engaging said track means and retaining said platform means in alignment with said track;

powering means positioned within said housing and connected to said at least one wheel for turning said at least one wheel and imparting motion to the platform; and sensor means for sensing a position of said platform means and pausing motion of said platform means for an adjustable predetermined pause time upon sensing a predetermined position of said platform means along said track means;

c) reflector means positioned along the length of said track means wherein said sensor means transmits a position signal, said position signal being reflected back towards said sensor upon passing of said reflector means by said platform means, said sensor means pausing said power means from turning said at least one wheel for a predetermined time period upon receipt of said reflected signal from said reflector means.

2. The moving platform/target system as recited in claim 1, wherein said power means includes a rechargeable battery for supplying power to said power means.

3. The moving platform/target system as recited in claim 1, wherein said track means includes first and second sides, said sensor means includes a pause sensor and a stop sensor, and said reflector means includes a plurality of pause reflectors positioned along said first side of said track and a stop reflector positioned along said second side of said track, said stop and pause sensors constantly transmitting a position signal upon activation of said power means and said pause reflector reflecting said position signal back towards said pause sensor upon passing said pause reflector by said platform means, wherein said pause sensor ceases said power means from turning said at least one wheel for a predetermined adjustable period upon receipt of said reflected signal from said pause reflector.

4. The moving platform/target system as recited in claim 1, wherein said platform means further includes adjustment means for adjusting said predetermined time said sensor means pauses said power means from turning said at least one wheel.

5. The moving platform/target system as recited in claim 3, wherein said stop sensor ceases said power means from turning said at least one wheel for an adjustable period and said platform means further includes adjustment means for adjusting said predetermined time said stop sensor means stops said power means from turning said at least one wheel.

6. The moving platform/target system as recited in claim 2, wherein said platform means further includes a control panel having an electrical input connected to said power means and an external power source for connection to said rechargeable battery via said electrical input.

7. The moving platform/target system as recited in claim 6, wherein said control panel further includes an ignition switch connected to manually activate said power means.

8. The moving platform/target system as recited in claim 6, wherein said control panel further includes an emergency stop switch for disconnecting said power means from said rechargeable battery to cease motion of said platform means.

9. The moving platform/target system as recited in claim 6, wherein said control panel further includes a speed control connected to regulate said speed at which said power means turns said wheels.

10. The moving platform/target system as recited in claim 3, wherein said track means includes first and second parallel opposing walls each including a projection extending perpendicular thereto and towards said opposing one of said first and second walls to form a recess therebetween.

11. The moving platform/target system as recited in claim 10, wherein said guide means includes:

a) a guide assembly having first and second ends connected at said first end to said housing;

b) roller means connected to said second end of said guide assembly and positioned within said recess formed in said track means;

c) first and second stop blocks connected to said guide; and d) spring means positioned around said guide and between said first and second stop blocks for absorbing shock resulting from motion of said platform.

12. The moving platform/target system as recited in claim 3, wherein said track means comprises a guide wire extending along the length of the path to be traversed by said platform and said platform further includes first and second position sensors positioned on either side of said guide wire for sensing a position of said platform with respect to said guide wire, and said at least one wheel includes first and second wheels, wherein said first and second position sensors are connected to said power means for controlling a speed of rotation of said first and second wheels thereby controlling turning of the platform in one of the left and right directions upon sensing said platform has varied its position with respect to said guide wire.

13. The moving platform/target system as recited in claim 12, wherein said platform further includes first and second ends and said guide means includes:

a) first and second protrusions extending from said first and second ends of said platform means respectively;

b) first and second guide wheels; and c) first and second connection means each for connecting a respective one of said first and second guide wheels to a respective one of said protrusions, said first and second protrusions being spring loaded to force said guide wheels against said guide wire and said first and second wheels against a ground for shock absorption.

14. The moving platform/target system as recited in claim 13, further comprising a transmitter device for transmitting a control signal and said platform means further includes a receiver device connected to said power means for receiving said control signal from said transmitter device, analyzing said control signal and controlling activation and deactivation of said power means based upon said analysis.

15. The moving platform/target system as recited in claim 14, wherein said power means includes first and second power circuits, each power circuit being connected to turn a respective one of said first and second wheels and one of said first and second sensors for controlling a direction of motion of said platform.

16. The moving platform/target system as recited in claim 1, further comprising a target connected to said platform means.

17. The moving platform/target system as recited in claim 1, wherein said at least one wheel includes first and second wheels each positioned on a respective one of said first and second sides of said platform means.

18. The moving platform/target system as recited in claim 1, wherein said predetermined pause time period is within a range of between 1–60 seconds.

19. The moving platform/target system as recited in claim 3, wherein said predetermined start up pause period is within a range of between 0 seconds and 3 minutes.

* * * * *